US010633146B2

(12) United States Patent
Schulte

(10) Patent No.: US 10,633,146 B2
(45) Date of Patent: Apr. 28, 2020

(54) PAPER BAG AND MANUFACTURING METHOD FOR A PAPER BAG

(71) Applicant: dy-pack Verpackungen Gustav Dyckerhoff GmbH, Wenden-Gerlingen (DE)

(72) Inventor: Gerhard Schulte, Lindlar/Frielingsdorf (DE)

(73) Assignee: dy-pack Verpackungen Gustav Dyckerhoff GmbH, Wenden-Gerlingen (DE)

( * ) Notice: Subject to any disclaimer, the term of this patent is extended or adjusted under 35 U.S.C. 154(b) by 446 days.

(21) Appl. No.: 15/304,752

(22) PCT Filed: Apr. 20, 2016

(86) PCT No.: PCT/EP2016/000640
§ 371 (c)(1),
(2) Date: Oct. 17, 2016

(87) PCT Pub. No.: WO2016/180513
PCT Pub. Date: Nov. 17, 2016

(65) Prior Publication Data

US 2017/0137178 A1 May 18, 2017

(30) Foreign Application Priority Data

May 13, 2015 (DE) ..... 10 2015 006 212

(51) Int. Cl.
*B65D 30/12* (2006.01)
*B65D 30/18* (2006.01)
(Continued)

(52) U.S. Cl.
CPC ..... *B65D 31/02* (2013.01); *B31B 70/00* (2017.08); *B31B 70/85* (2017.08); *B65D 31/04* (2013.01);
(Continued)

(58) Field of Classification Search
CPC ..... B65D 31/08; B65D 31/142; B65D 31/145
(Continued)

(56) References Cited

U.S. PATENT DOCUMENTS 221,712 A * 11/1879 Adams ..... B65D 31/08 383/126
3,231,173 A * 1/1966 Civitello ..... B65D 31/08 383/115
(Continued)

FOREIGN PATENT DOCUMENTS

CH 480 988 A 12/1969
DE 10 2007 015099 A1 10/2008
(Continued)

*Primary Examiner* — Jes F Pascua
*Assistant Examiner* — Nina K Attel
(74) *Attorney, Agent, or Firm* — Dilworth & Barrese, LLP

(57) ABSTRACT

This invention relates to a paper bag for bulk material such as cement, gypsum, granular material, animal feed or the like, with a bottom and with an upper part opposite the bottom, wherein bottom and/or upper part are folded and glued by closing up the side parts around side fold lines, in particular in the form of a cross or block bottom, wherein for gluing the side parts at least one gluing or bonding agent activatable after the application is provided, which is applied continuously at least from a side fold line up to at least the opposite side fold line of the side parts.

17 Claims, 4 Drawing Sheets

(51) Int. Cl.

| | |
|---|---|
| ***B65D 30/08*** | (2006.01) |
| ***B65D 30/24*** | (2006.01) |
| ***B31B 70/00*** | (2017.01) |
| ***B31B 70/85*** | (2017.01) |
| ***B65D 33/01*** | (2006.01) |
| *B31B 160/20* | (2017.01) |
| *B31B 155/00* | (2017.01) |
| *B31B 70/74* | (2017.01) |
| *B31B 70/62* | (2017.01) |

(52) U.S. Cl.
CPC ..... *B65D 31/08* (2013.01); *B65D 31/142* (2013.01); *B65D 33/01* (2013.01); *B31B 70/62* (2017.08); *B31B 70/79* (2017.08); *B31B 2155/00* (2017.08); *B31B 2160/20* (2017.08)

(58) Field of Classification Search
USPC ..... 383/121, 125, 126, 44, 52, 54
See application file for complete search history.

(56) References Cited

U.S. PATENT DOCUMENTS

| | | | | |
|---|---|---|---|---|
| 3,466,981 | A | 9/1969 | Honsel | |
| 3,519,195 | A | 7/1970 | Kühnle | |
| 3,955,690 | A * | 5/1976 | Baxter | B65D 31/02 410/118 |
| 2004/0198575 | A1 * | 10/2004 | Finch | B65D 31/08 493/218 |
| 2012/0033903 | A1 | 2/2012 | Lisek et al. | |
| 2012/0273561 | A1 * | 11/2012 | Irvin | B31F 1/2886 229/199 |

FOREIGN PATENT DOCUMENTS

| | | | |
|---|---|---|---|
| DE | 20 2010 010512 | U1 | 10/2010 |
| DE | 10 2009 036556 | A1 | 2/2011 |
| EP | 1 858 769 | B1 | 10/2008 |
| WO | 2005/115857 | A1 | 12/2005 |

* cited by examiner

PAPER BAG AND MANUFACTURING METHOD FOR A PAPER BAG

BACKGROUND OF THE INVENTION

This invention relates to a paper bag for in particular fine-grained bulk material such as cement, gypsum, granular material, animal feed or the like, with a bottom and with an upper part opposite the bottom, wherein bottom and/or upper part are folded and glued by closing up the side parts around side fold lines, in particular in the form of a cross or block bottom. Another aspect of the invention relates to a special manufacturing method for such paper bag.

Generic paper bags are known, for example from EP 1 858 769 B1. Widespread in the trade in particular are the usual sizes of 5 kg, 10 kg or 25 kg. They have one or more paper layers which are formed of paper or a paper compound and/or coated paper. Layers of other materials also can be present, for example a plastic film like in the case of EP 1 858 769 B1.

Such paper bags generally are manufactured from endless paper webs whose longitudinal edges are glued together to form a tube. To form the bags, the tube is cut into portions of suitable length and at the open ends of the tube portions bottom and upper part are folded and glued, in order to close the paper bag at the bottom and/or at the top. Usually, there is chosen a cross or block bottom folding, wherein in general a creasing or the like is made to facilitate folding in the region of the fold lines. The folded parts are glued together by means of a glue, usually a starch-water mixture. For manufacturing reasons, however, the used glue must be left out in the region of the fold lines. This restriction is due to the fact that in the region of the fold lines and in the edge region the glue would lead to soiling of the production machine for the manufacture of paper bags and a continuous production of the paper bags would thus not be possible. In particular, when applying a creasing in the region of the fold lines, a glue application present in this region would lead to strong soiling of the tools used in the machine for creasing. In addition, when applying the starch-glue pattern a certain minimum distance from the edges or lateral edges of the bottom/upper part also must be maintained, as otherwise soiling and gluing together of certain machine parts likewise is likely to occur.

Due to the omission of glue, however, a non-glued region remains along the fold lines and edges/lateral edges in the bottom and/or upper part of the paper bag. This may produce channels which provide for the exit of the dust-like filling material also after closing of the bag.

Furthermore, closing up the bottom/upper part effects a certain compression of the paper, whereby undulations of the paper as well as folds and displacements are obtained in the region of the abutting edges of the center of the bottom, also referred to as bottom center line. These undulations, folds and edges also cannot be glued completely with the starch glue, as the same does not enter completely and does not reach up to the folded edge. This leads to an additional channeling beside the channels of the fold lines, which increase the exit quantity of the filling material.

SUMMARY OF THE INVENTION

The present invention therefore deals with the object to provide more dust-tight paper bags.

This object is solved by a paper bag and manufacturing method according to the features described herein. Advantageous aspects of the paper bag and of the method are subject-matter of the description herein.

The invention proceeds from a generic paper bag with the features described herein. According to the invention at least one gluing or bonding agent activatable after the application is provided for gluing the side parts, wherein its application surface continuously extends at least from one side fold line to at least the opposite side fold line of the side parts. What is essential for the invention is the application of a continuous bead of gluing or bonding agent from one side fold line to the opposite side fold line, and the shape and thickness of the patch can be chosen as desired, with a strip shape being preferred.

It furthermore is decisive that the application starts directly within the side fold lines and extends at least to the opposite side fold line. This results in a continuous adhesive bond on folding of the paper bag, and the aforementioned disadvantageous channeling can be prevented effectively. The subsequent activation allows the application at the beginning of the manufacturing process. In the deactivated condition there is thus no risk that individual machines are soiled during the subsequent manufacturing process. An activation preferably is effected only directly before the final folding of the paper bag. Individual fold lines as well as edge regions accordingly need not be left out—like when using a starch glue—, but can completely be provided with the gluing or bonding agent.

Side fold lines are understood to be those fold lines around which the side flaps are closed up. In the case of cross and block bottom folding, folding is effected at the end along the two side flap fold lines, so that these fold lines lead to the exterior of the bag. At the outer regions of the side flap fold lines the end tucks are located, which in the cross bottom are formed as outwardly pointed corner tucks and in the block bottom are formed as trapezoidal tucks. The side parts are folded inwards around the side fold lines, in order to glue the same to the end tucks and/or to each other by means of the gluing or bonding agent.

Advantageously, at least one continuous patch of adhesive or bonding agent is provided in each end region of the side fold lines, i.e. in the region of the two end tucks. In general, both at the bottom part and at the upper part at least two, preferably four continuous application surfaces of the gluing or bonding agent can each be provided. As far as an integration of a valve for filling the paper bag is provided, the application of gluing or bonding agent in the region of the valve tube can be omitted.

Preferably, at least one patch of gluing or bonding agent extends between the end regions of the respective side fold lines, in particular transversely to the bottom center line, which lies between the respective side fold lines and is to be closed by folding the side parts together.

It likewise is conceivable that the applied patch of adhesive or bonding agent extends beyond at least one of the side fold lines, preferably directly up to the edge of the end tucks or beyond onto their back.

What also is preferred is an application of several strip-like patches of gluing and/or bonding agent extending parallel to each other, preferably at least two strips extending in parallel are provided in the region of each end tuck of the upper part and/or bottom.

In addition, there can also be provided a non-continuous patch or strip of gluing or bonding agent, whose sections at least fall onto the side fold lines and/or the center fold line. The application of such adhesive pattern of at least two strips of gluing or bonding agent extending in parallel, ideally in combination with a non-continuous strip of gluing or bonding agent, is advantageous in particular when for gluing the side parts another type of adhesive is used in addition. The gluing patches with different types of adhesive can overlap each other or separately be arranged side by side.

Preferably, for a firm and stable adhesive bond the bottom and/or upper part or their fold parts additionally are glued with a separately applied glue, possibly with another type of glue, in particular on the basis of a starch-water mixture, wherein this glue is not applied in the region of the fold lines and not in the edge region of the side parts or tucks, i.e. the application of glue spares these regions. What is particularly advantageous is the application of the gluing agent and/or bonding agent according to the invention in regions adjacent to the glue application. What is ideal is an alternating application of the glue and the used gluing and/or bonding agent in folding direction. For example, regions of the side parts lying one beside the other in direction of the fold lines alternately are glued to the tucks with the starch glue or the gluing or bonding agent. Due to this procedure, the advantages of both types of gluing can be exploited in each relevant region of the adhesive bond. Gluing with starch glue on paper provides a particularly good and mechanically firm adhesive bond, as a good fiberization of the glued paper layers is achieved and the adhesive bond penetrates into the paper particularly deeply. The adhesive bond with the used gluing or bonding agent on the other hand is not so firm, but due to the continuous application transversely to the bottom center line provides a full-surface adhesive bond, whereby the disadvantageous channeling is avoided and the resulting channels of the starch glue adhesive bond are closed.

As gluing agent there is preferably used a wet gum or so-called envelope glue, which can be activated by liquid or steam addition, in particular water or steam. This property has the advantage that the adhesive, i.e. the wet gum or the envelope glue, can be deactivated after application on the paper bag, for example by drying, in order to avoid soiling of the production machines during the manufacture. Directly before or after folding, the adhesive can then be activated.

As bonding agent for example a sealing composition, preferably a cold sealing composition can be used, which is activated on compression of surfaces provided with the sealing composition and then acts as adhesive. An application of liquid or steam in this case is not necessary. What likewise is imaginable is the use of a hot melt adhesive which is deactivated by cooling and can be reactivated with subsequent supply of heat.

In a preferred aspect of the invention at least one film for closing the paper bag can be glued to the side parts and/or the end tucks by means of the gluing and/or bonding agent and/or the applied glue. The incorporation of such film, also referred to as inner lining, in particular a water- and dust-tight film, serves to realize a particularly preferred closure of the paper bag. The actual dust-tight bag closure accordingly no longer is effected by folding the side parts, but merely by applying the film. Preferably, however, the side parts also are folded and glued as known for transport purposes.

The film forming the inner lining preferably can be formed of paper and/or coated paper and/or plastic material and/or a metal foil. The inner lining can cover the applied patch of gluing and/or bonding agent either partly or also completely. In the case of the partial coverage, the excess region of gluing or bonding agent can serve for gluing the side parts.

Beside the paper bag according to the invention, the invention relates to a method for manufacturing the paper bag according to the invention with a folded bottom and/or upper part. Before folding the bottom and/or the upper part, a gluing and/or bonding agent according to the invention is applied and/or printed onto a paper roll or paper web for manufacturing the paper bags. The application of the gluing and/or bonding agent is effected such that a paper bag of the invention is obtained according to the present invention or an advantageous aspect of the invention. The paper bag subsequently is folded and glued in the bottom laying machine only after applying the patch of gluing and/or bonding agent onto the paper roll or paper web, wherein the activation of the used gluing and/or bonding agent is effected only directly before or during folding or gluing of the side parts.

Furthermore, a water-starch mixture preferably is applied in the bottom laying machine, so that a gluing region with alternating patches of gluing/bonding agent and starch glue is obtained, in particular alternating in direction of the side fold or bottom center lines.

According to a preferred embodiment of the method the activation of the previously applied gluing agent in the bottom laying machine can be effected by addition of water and/or steam. When using a water-starch mixture for gluing the side parts, it is expedient to at the same time activate the applied gluing agent in the bottom laying machine by this addition of water. Additionally or alternatively an addition of steam through a pressure nozzle likewise can be effected.

In an optional method step at least one inner lining for the air-tight closure of the bag can be glued onto the folded, but still open bottom and/or upper part region by means of the applied gluing and/or bonding agent and/or the starch-water mixture.

The application of the gluing and/or bonding agent onto the paper web or paper roll preferably is effected via an impression cylinder which intermittently prints the desired patch shape, so that the gluing or bonding agent pattern according to the invention is obtained. The application of this gluing and/or bonding agent advantageously is effected by means of a flexographic printing machine.

The size and shape of the application patch and the application thickness of the gluing or bonding agent can be designed variable, for example in dependence on the used materials and/or the production plant and/or the intended application of the manufactured paper bag, i.e. in dependence on the desired filling material.

In a preferred aspect of the invention the chosen gluing and/or bonding agent is deactivated during the method after being applied for subsequent creasing or some other treatment of the fold lines, for example by active or passive drying of the applied gluing agent, so that machine parts or tools subsequently used for creasing or some other treatment are not soiled by the adhesive present in this region. After this creasing or treatment, i.e. when no more machine parts or tools get in contact with the fold lines, the adhesive can be activated. In another preferred aspect of the invention a hot melt adhesive also can be used as gluing agent, which can be activated by supplying heat. Particularly preferably the hot melt adhesive is applied onto the paper bag in the warm or hot condition and initially deactivated after the application by means of cooling. Later on, the activation of the hot melt adhesive is effected by supplying heat for closing up or shutting the bottom or upper part.

When a sealing composition, in particular a cold sealing composition preferably is used, the adhesive effect can be activated in that patches which are covered with the cold sealing composition are compressed. For this purpose, the cold sealing composition not only must be applied between the side fold lines, but also on the regions of the side parts which are pressed onto the corresponding patch between the fold lines.

BRIEF DESCRIPTION OF THE DRAWINGS

Further advantages and properties of the invention will be explained in detail below with reference to an exemplary embodiment illustrated in the drawings.

In the drawings.

DESCRIPTION OF THE PREFERRED EMBODIMENTS

Figure 1:
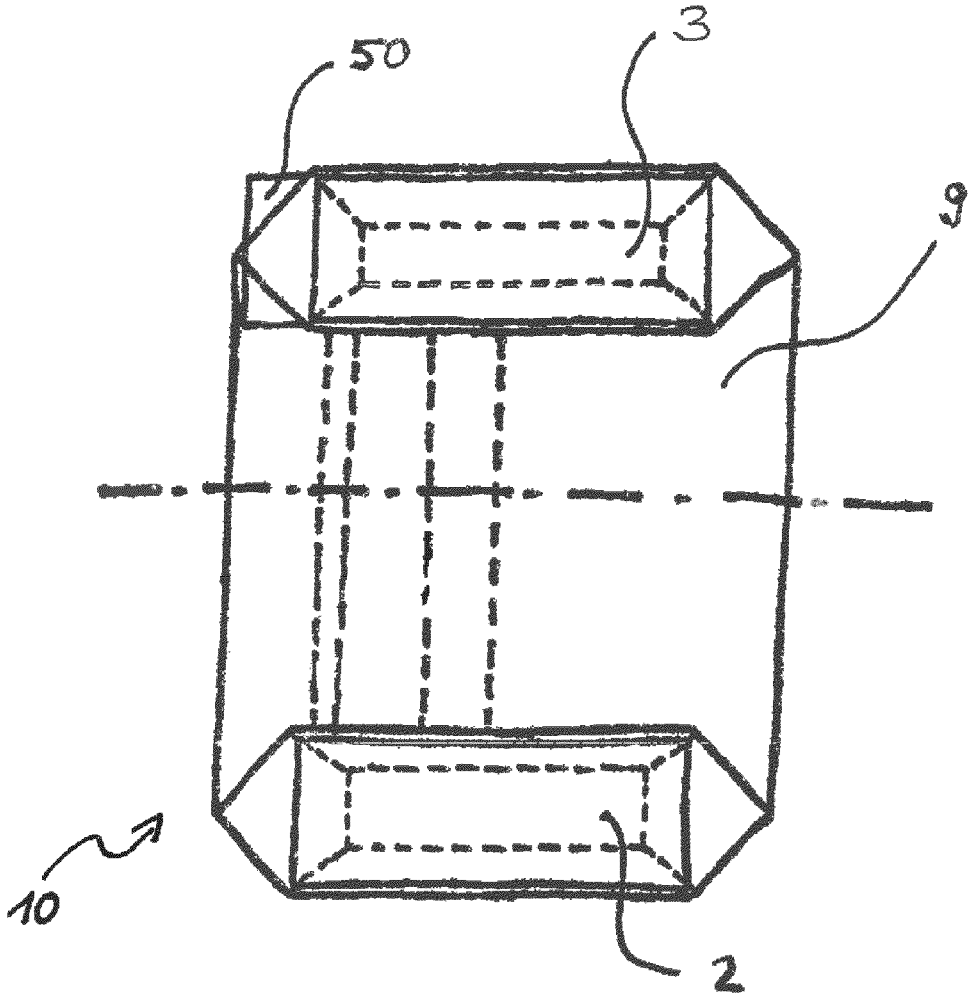
FIG. 1: shows a schematic top view of a paper bag according to the invention with bottom and upper part.

FIG. 1 shows the paper bag 10 according to the invention with a cross bottom 2 and an upper part 3, wherein the bottom 2 and the upper part 3 are folded on the front side 9 of the paper bag 10. What is not visible is the rear side of the bag 10, which lies below the front side 9. In the upper part 3 a valve tube 50 is inserted for filling the paper bag 10.

The paper bag can comprise two or more paper or material layers. The concrete design of the paper bag 10, i.e. the used number of paper or material layers is irrelevant for the execution of the invention, which is why this will not be discussed in more detail. In the upper part a valve 50 known per se can be provided for filling the bag.

Figure 2:
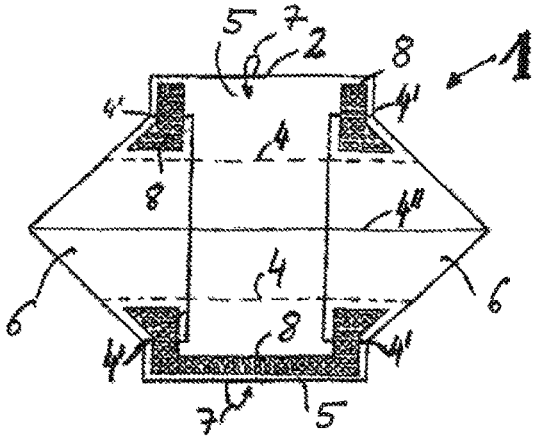
Fig.2 PRIOR ART
FIG. 2: shows a top view of the open bottom of a paper bag according to the prior art.

To demonstrate the advantages of the present invention an initially open, partly folded bottom part 2 of a conventional paper bag 1 is shown, which is illustrated in FIG. 2. There can be seen a detailed view of the bag bottom 2 of the conventional paper bag 1 with cross bottom. In FIG. 2, however, the cross bottom 2 is not closed, but the side flaps 5 are open and the corner tucks 6 can be seen. For folding the cross bottom, both side flaps 5 are folded to the inside in direction of arrow 7, namely along the respective side flap fold lines 4 which are provided with a bottom creasing.

For gluing the cross bottom, i.e. the two side flaps 5, a glue 8 of a starch-water mixture flatly is applied in certain regions on the corresponding surfaces, in order to glue the upper side flap 5 to the corner tucks 6 and the lower side flap 5 to the surface of the side flap 5 already folded in. It can furthermore be seen in FIG. 2 that in the region of the creased upper and lower side flap fold lines 5 the glue 8 is left out and this region hence remains free of glue. The same applies for the edge regions of the corner tucks 6 and of the side flaps 5, the outer edge remains free of glue throughout.

Such omission has the technical background that during the production, in particular when making the bottom creasing along the fold lines 4, no glue must get onto the necessary production tools or when applying the glue in the edge region soiling of underlying machine parts would occur. Due to the omission of glue 8 along the fold lines 4 and in the edge region, however, an air-permeable and dust-permeable channel disadvantageously is obtained, from which filling material from the interior of the bag can get to the outside via the bag edges 20 marked in FIG. 6 as well as the exit 21 of the bottom center line 4". Channeling is increased by the fact that on closing of the bottom a compression of the paper occurs, whereby in addition an undulation of the paper and a wrinkling and displacement in the region of the abutting edges of the bottom center line 4" occurs. These undulations, folds and edges also cannot be glued completely with the starch glue 8, as the same does not enter completely and does not reach up to the folded edge.

Figure 3:
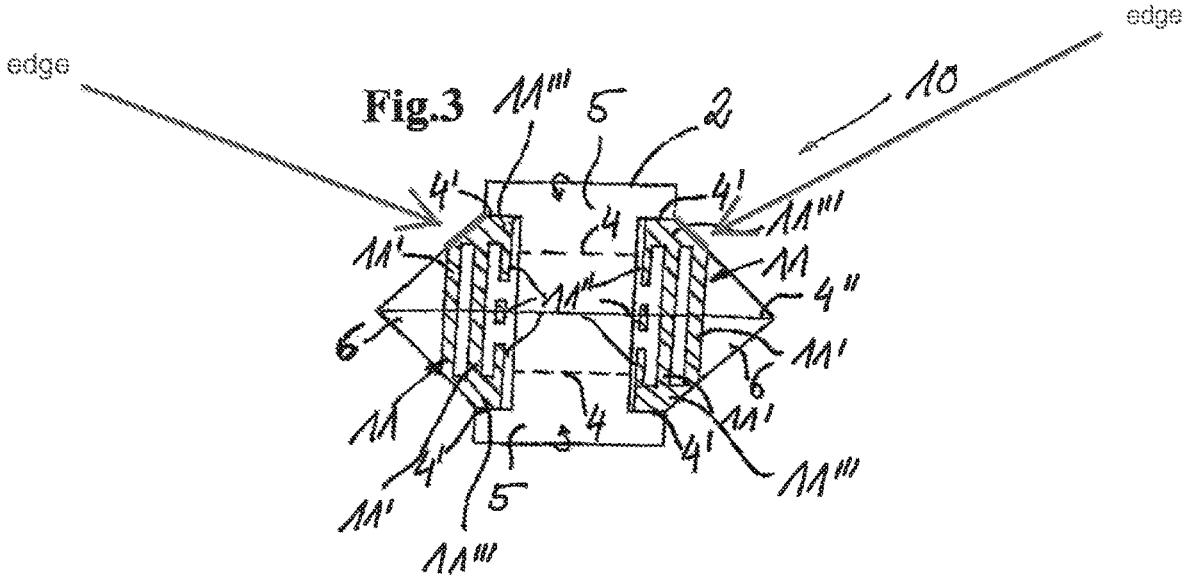
FIG. 3: shows a top view of the open bottom of the paper bag according to the invention.

The solution approach according to the invention is illustrated in FIG. 3. The representation likewise shows a detailed view of an open, partly folded cross bottom 2 of the paper bag 10 according to the invention. The features of the cross bottom 2 identical with respect to the prior art are provided with identical reference numerals. The wet gum 11 according to the invention continuously is applied between the two side fold lines 4 of the side parts 5. In particular, the distinctive points in the region of the side fold lines 4, the indentations 4' and possible paper folds especially in the region of the bottom center 4" are closed air-tight, so that an exit of the filling material with closed paper bag 10 is prevented.

In the representation according to FIG. 3 it can furthermore be seen that the wet gum 11 is applied onto the corner tucks 6 of the bottom 2 in a special adhesive pattern. In particular, two parallel continuous adhesive strips 11' and an interrupted adhesive strip 11" extend from one side fold line 4 to the opposite side fold line 4. At their ends, the adhesive strips 11', 11" are connected with each other via an all-over adhesive surface 11".

This advantageous arrangement of the adhesive surface 11 serves to achieve an application of activatable adhesive 11 and conventional starch glue 8 alternating in direction of the center fold line 4", whereby advantageous use can be made of the positive properties of both gluing agents 8, 11. The starch glue 8 is applied as usual with the pattern according to FIG. 2.

As adhesive a wet gum 11 is proposed in the exemplary embodiment, but as alternatives the use of a sealing composition, in particular cold sealing composition, or of a hot melt adhesive also is conceivable.

Figure 4:
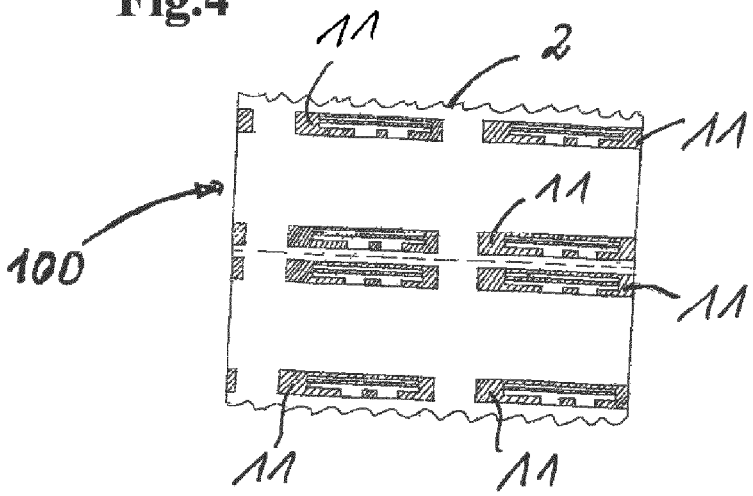
FIG. 4: shows a schematic representation of a section of a paper web for manufacturing a paper bag according to the invention.

The manufacturing method for the production of the paper bag 10 according to the invention with the fold lines 4, 4" closed in a dust-tight manner will be explained below. The adhesive 11 in the form of the wet gum or the cold sealing composition is intermittently applied in a flexographic printing machine via an impression cylinder onto a paper roll or paper web 100, as it is shown in FIG. 4. The adhesive 11 is applied in the region of the paper web 100, so that in the following process of bottom folding the same will then provide the adhesive pattern 11 as shown in FIG. 3.

The size and shape of the application patch and the application thickness of the activatable adhesive 11 or the cold sealing composition can be designed variable, for example in dependence on the material used for the manufacture of the paper bag 10 or the used manufacturing process or in dependence on the selected filling material for the produced paper bag 10.

Figure 5:
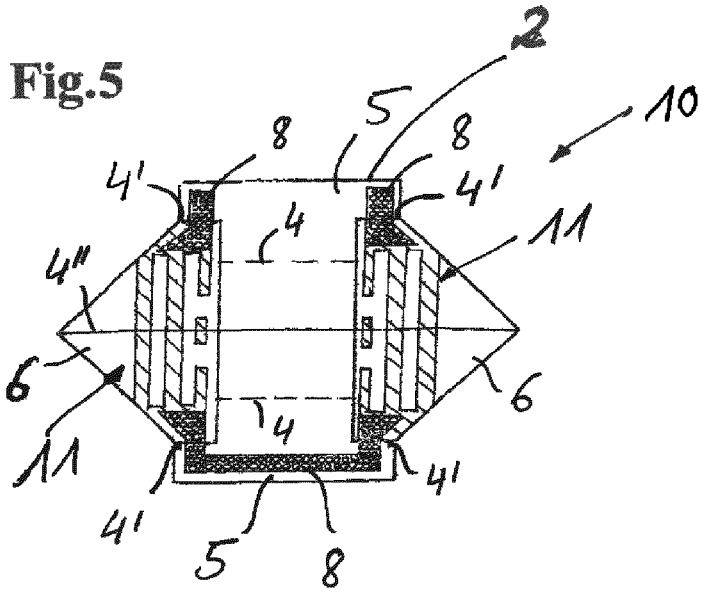
FIG. 5: shows another top view of the paper bag according to the invention with open bottom.

In the next step the paper web 100 is folded together overlappingly in longitudinal direction and glued in the so-called tuber and thus formed into a tube and then cut to a suitable length. The tube portions pre-printed with the adhesive 11 or cold sealing composition subsequently are conveyed to the bottom laying machine of the manufacturing process. On the bottom laying machine the bag bottoms 2, as shown in FIG. 3, are folded and the known glue mixture 8 for gluing the cross bottom 2, as shown in FIG. 5, is applied onto the side parts 5 as well as the corner tucks 6. The used glue 8 is based on a starch-water mixture, wherein during the application care should be taken that the same is left out in the region of the side flap fold lines 4 and in the edge regions of the side flaps 5 and the corner tucks 6. Likewise on the bottom laying machine a bottom creasing is produced along the side flap fold lines 4.

The moistening necessary for activation of the adhesive 11 is effected by the applied starch-water mixture 8. This is achieved in that the adhesive 11 is activated by the capillary effect of the paper. The water contained in the starch glue 8 spreads in the paper and diffuses to the adhesive points 11, whereby the same are partially dissolved and made sticky in the manner of an envelope glue.

Optionally, the moistening of the adhesive 11 can be supported by a suitable nozzle by means of steam.

Figure 6:
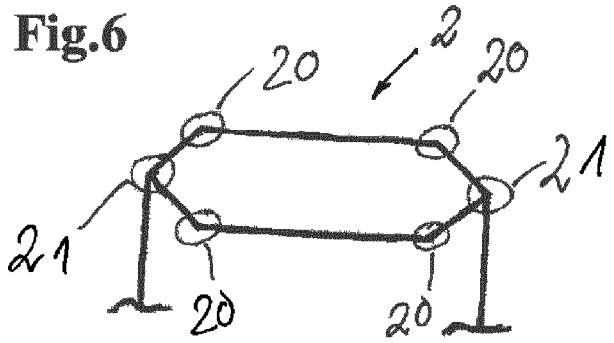
FIG. 6: shows a top view of the closed bottom of the paper bag according to the invention.

The folded cross bottom 2 of the paper bag 10 according to the invention now is closed well in the region of the side flap fold lines 4, of the bottom center channel 4" and of the edge regions 4', so that in particular in the region of the marked bag edges 20 of FIG. 6 no more filling material can escape. The bag 10 thereby becomes distinctly more dust-tight and thus prevents soiling of the filling plant of the customer as well as soiling of the filled bags 10 on the pallet.

The upper part 3 can be designed in a way analogous to the bottom 2.

Preferably, before folding the side parts 5 a so-called inner lining can be applied in addition, which air-tightly closes the bottom part 2 of the paper bag 10. Such inner lining for example consists of a plastic film which either completely covers the adhesive surfaces of the adhesive 11 or alternatively is only partly glued onto certain surfaces of the adhesive 11. Gluing in any case is effected such that the opening of the bottom part 2 is glued completely air-tight and also dust-tight by means of the film. The side parts 5 do not contribute to the dust-tight closure of the paper bag, but folding merely serves the optical design of the paper bag 10 for transport purposes.

When an inner lining is used, the gum 11 also might be omitted in principle. When using an inner lining the procedure in particular can be such that a starch glue frame is applied on the inner lining, which then is glued onto the open bottom 2. The starch glue then is fully applied directly onto the bottom 2, so that no gum is necessary. Another variant can be designed such that the gum 11 for gluing the bottom is only partly covered by an inner lining. The non-covered part then is glued when closing up the bottom 2.

The invention claimed is:

1. A paper bag for bulk material such as cement, gypsum, granular material, animal feed or the like, with a front side, a rear side, a closed bottom and an upper closed part opposite the closed bottom, wherein at least one of the closed bottom and the upper closed part comprises a first side flap connected to the front side via a first fold line having a first outer end region and a second outer end region, a second side flap connected to the rear side via a second fold line having a first outer end region and a second outer end region, a first corner tuck located at the first outer end regions of the first and second fold lines and a second corner tuck opposite the first corner tuck and located at the second outer end regions of the first and second fold lines, the at least one of the closed bottom and the upper closed part is formed by folding the first and second side flaps and by gluing the first and second side flaps to the first and second corner tucks and/or each other, the folding of the first and second side flaps comprises folding the first side flap around the first fold line and the second side flap around the second fold line such that the first and second side flaps are folded over each other and over the first and second corner tucks, the gluing of the first and second side flaps to the first and second corner tucks and/or each other comprises providing each of the first and second corner tucks with several strip-like patches of gluing or bonding agent extending parallel to each other and activatable after application, wherein the several strip-like patches are applied continuously at least from the first fold line to at least the second fold line, and the gluing of the first and second side flaps to the first and second corner tucks and/or each other additionally comprises providing each of the first and second corner tucks with at least one non-continuous patch or strip of gluing or bonding agent extending parallel to the several continuous strip-like patches of gluing or bonding agent and having sections which fall at least onto the first and second fold lines and/or a center fold line positioned between the first and second fold lines.

2. The paper bag according to claim 1, wherein the gluing agent is a wet gum which can be activated by addition of liquid or steam and the bonding agent is a sealing composition.

3. The paper bag according to claim 2, wherein the gluing agent can be activated by water or steam and the bonding agent is a cold sealing composition.

4. The paper bag according to claim 1, wherein the at least one of the closed bottom and the upper closed part is additionally is glued by a separately applied glue, and the separately applied glue spares the first and second fold lines.

5. The paper bag according to claim 4, wherein the separately applied glue and the several strip-like patches of gluing or bonding agent are alternatingly applied in a folding direction.

6. The paper bag in accordance with claim 4, wherein the separately-applied glue is a starch-water mixture.

7. The paper bag according to claim 1, wherein at least one film for closing the paper bag is glued to the first and second side flaps and/or the first and second corner tucks by the several strip-like patches of gluing or bonding agent and the at least one non-continuous patch or strip of gluing or bonding agent.

8. The paper bag according to claim 7, wherein the at least one film completely or partly covers the several strip-like patches of the gluing or bonding agent.

9. The paper bag according to claim 1, wherein at least one of the several strip-like patches of the gluing or bonding agent extends directly to or beyond an edge of the first corner tuck and the second corner tuck.

10. The paper bag in accordance with claim 1, wherein the several strip-like patches are straight.

11. A method for manufacturing the paper bag with the closed bottom and/or the upper closed part according to claim 1, wherein the several strip-like patches of the gluing or bonding agent are applied and/or printed onto a paper roll or paper web for manufacturing the paper bag and subsequently the closed bottom and/or the upper closed part is formed by the folding of the first and second side flaps in a bottom laying machine.

12. The method according to claim 11, wherein in the bottom laying machine a starch-water mixture is applied, so that an alternating pattern of the several strip-like patches of the gluing or bonding agent and the starch-water mixture is obtained.

13. The method of claim 12, wherein the several strip-like patches of the gluing or bonding agent and the starch-water mixture alternate in a direction of the first and second fold lines and the center fold line.

14. The method according to claim 11, wherein an activation of the several strip-like patches of the gluing agent is effected in the bottom laying machine by addition of water and/or steam.

15. The method according to claim 11, wherein prior to forming the closed bottom and/or the upper closed part, a film for an air-tight closure of the bag is glued by the several strip-like patches of the gluing or bonding agent and/or a starch-water mixture.

16. The method according to claim 15, wherein the adhered film completely or only partly covers the several strip-like patches of the gluing or bonding agent.

17. The method according to claim 11, wherein the several strip-like patches of the gluing or bonding agent are intermittently applied onto the paper web or paper roll via an impression cylinder.

* * * * *